US009863391B2

(12) United States Patent
Sekine et al.

(10) Patent No.: US 9,863,391 B2
(45) **Date of Patent: *Jan. 9, 2018**

(54) IGNITION DEVICE

(71) Applicants: SANKEN ELECTRIC CO., LTD., Niiza-Shi (JP); DENSO CORPORATION, Kariya (JP)

(72) Inventors: Nobuaki Sekine, Kawagoe (JP); Shunichi Takeda, Kariya (JP)

(73) Assignees: SANKEN ELECTRIC CO., LTD., Niiza-shi (JP); DENSO CORPORATION, Kariya (JP)

( * ) Notice: Subject to any disclaimer, the term of this patent is extended or adjusted under 35 U.S.C. 154(b) by 63 days.

This patent is subject to a terminal disclaimer.

(21) Appl. No.: 14/972,320

(22) Filed: Dec. 17, 2015

(65) Prior Publication Data

US 2016/0245255 A1 Aug. 25, 2016

(30) Foreign Application Priority Data

Feb. 23, 2015 (JP) ..... 2015-032524

(51) Int. Cl.

| | |
|---|---|
| ***F02N 11/08*** | (2006.01) |
| ***F02P 9/00*** | (2006.01) |
| ***F02P 3/05*** | (2006.01) |
| ***F02P 17/12*** | (2006.01) |
| ***F02P 3/04*** | (2006.01) |

(52) U.S. Cl.

CPC ..... *F02N 11/0862* (2013.01); *F02P 3/053* (2013.01); *F02P 9/007* (2013.01); *F02P 3/0435* (2013.01); *F02P 2017/121* (2013.01)

(58) Field of Classification Search

CPC ..... F02N 11/0862; F02P 9/007; F02P 3/053; F02P 2017/121; F02P 3/0435; F02P 3/043

USPC ..... 123/594

See application file for complete search history.

(56) References Cited

U.S. PATENT DOCUMENTS

| | | | | |
|---|---|---|---|---|
| 6,550,463 | B1 * | 4/2003 | Schmolla | F02P 3/005 123/605 |
| 8,893,692 | B2 * | 11/2014 | Brandes | F02P 3/053 123/644 |
| 9,410,526 | B2 * | 8/2016 | Sekine | F02P 15/12 |

(Continued)

FOREIGN PATENT DOCUMENTS

JP 2001-217131 A 8/2001

*Primary Examiner* — Joseph Dallo
*Assistant Examiner* — Scott A Reinbold
(74) *Attorney, Agent, or Firm* — Metrolexis Law Group, PLLC

(57) ABSTRACT

An embodiment of an ignition device comprises an ignition coil including a first winding and a second winding electromagnetically coupled to each other, a first switch electrically connected to a first end of the first winding, a battery electrically connected to a second end of the first winding, a booster with a first end electrically connected to the battery, a second switch electrically connected to a second end of the booster and to the second end of the first winding, and a drive device electrically connected to the first switch, that turns the first switch and the second switch on and off. The drive device feeds a secondary current to the second winding by changing the first switch from an on-state to an off-state, and supplies an output from the booster to the first winding by changing the second switch from an off-state to an on-state.

5 Claims, 6 Drawing Sheets

(56) References Cited

U.S. PATENT DOCUMENTS

| | | | | |
|---|---|---|---|---|
| 2002/0134363 | A1* | 9/2002 | Meinders | F02P 3/0435<br>123/620 |
| 2013/0068204 | A1* | 3/2013 | Trecarichi | F02P 3/0435<br>123/594 |
| 2013/0233291 | A1* | 9/2013 | Yamada | F02P 3/00<br>123/594 |
| 2016/0084213 | A1* | 3/2016 | Nakayama | F02P 3/0442<br>123/634 |
| 2016/0164263 | A1* | 6/2016 | Muramoto | F02P 9/007<br>315/279 |

* cited by examiner

IGNITION DEVICE

CROSS REFERENCE TO RELATED APPLICATIONS

This application claims priority based on 35 USC 119 from prior Japanese Patent Application No. 2015-032524 filed on Feb. 23, 2015, entitled "IGNITION DEVICE", the entire contents of which are hereby incorporated by reference.

BACKGROUND

This disclosure relates to an ignition device provided with an ignition coil for an internal combustion engine.

As a conventional ignition device, there has been known an ignition device disclosed in Japanese Patent Application Publication No. 2001-217131 (Patent Document 1), for example. As illustrated in FIG. 6, the ignition device provided with an ignition coil described in Patent Document 1 includes igniter control circuit 11, igniter switch Q1, transformer Ta, battery E, and diode D5, and adopts a fly-back control method.

Igniter control circuit 11 inputs an ignition signal and turns igniter switch Q1 on and off by using the ignition signal. Energy is stored in transformer Ta while igniter switch Q1 is on, and the energy stored in transformer Ta is supplied to plug 16 when igniter switch Q1 is turned off, and plug 16 is thus ignited.

SUMMARY

An embodiment of an ignition device comprises an ignition coil including a first winding and a second winding electromagnetically coupled to each other, a first switch electrically connected to a first end of the first winding, a battery electrically connected to a second end of the first winding, a booster with a first end electrically connected to the battery, a second switch electrically connected to a second end of the booster and to the second end of the first winding, and a drive device electrically connected to the first switch, that turns the first switch and the second switch on and off. The drive device feeds a secondary current to the second winding by changing the first switch from an on-state to an off-state, and supplies an output from the booster to the first winding by changing the second switch from an off-state to an on-state.

DETAILED DESCRIPTION

Figure 6:
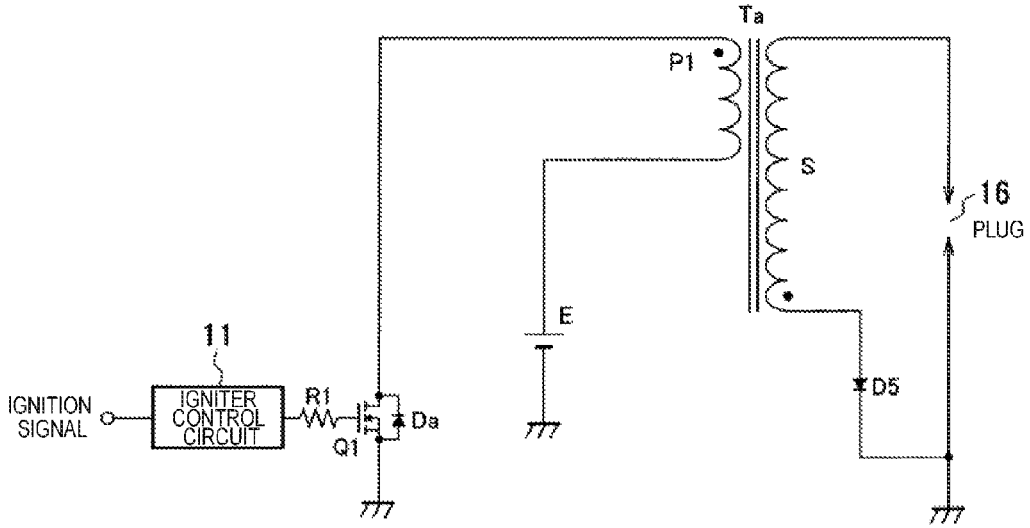
FIG. 6 is a diagram illustrating a circuit configuration of a conventional ignition device.

In the conventional ignition device illustrated in FIG. 6, electric power is supplied only from the battery. On the other hand, in the following example, electric power is supplied from an auxiliary boost converter to an igniter winding. Moreover, in the example, constant current control is performed by detecting a plug current and feeding the detected plug current back to the auxiliary boost converter. Furthermore, in this example, energy is supplied from the single boost converter to multiple cylinders by using a cylinder change switch.

Figure 1:
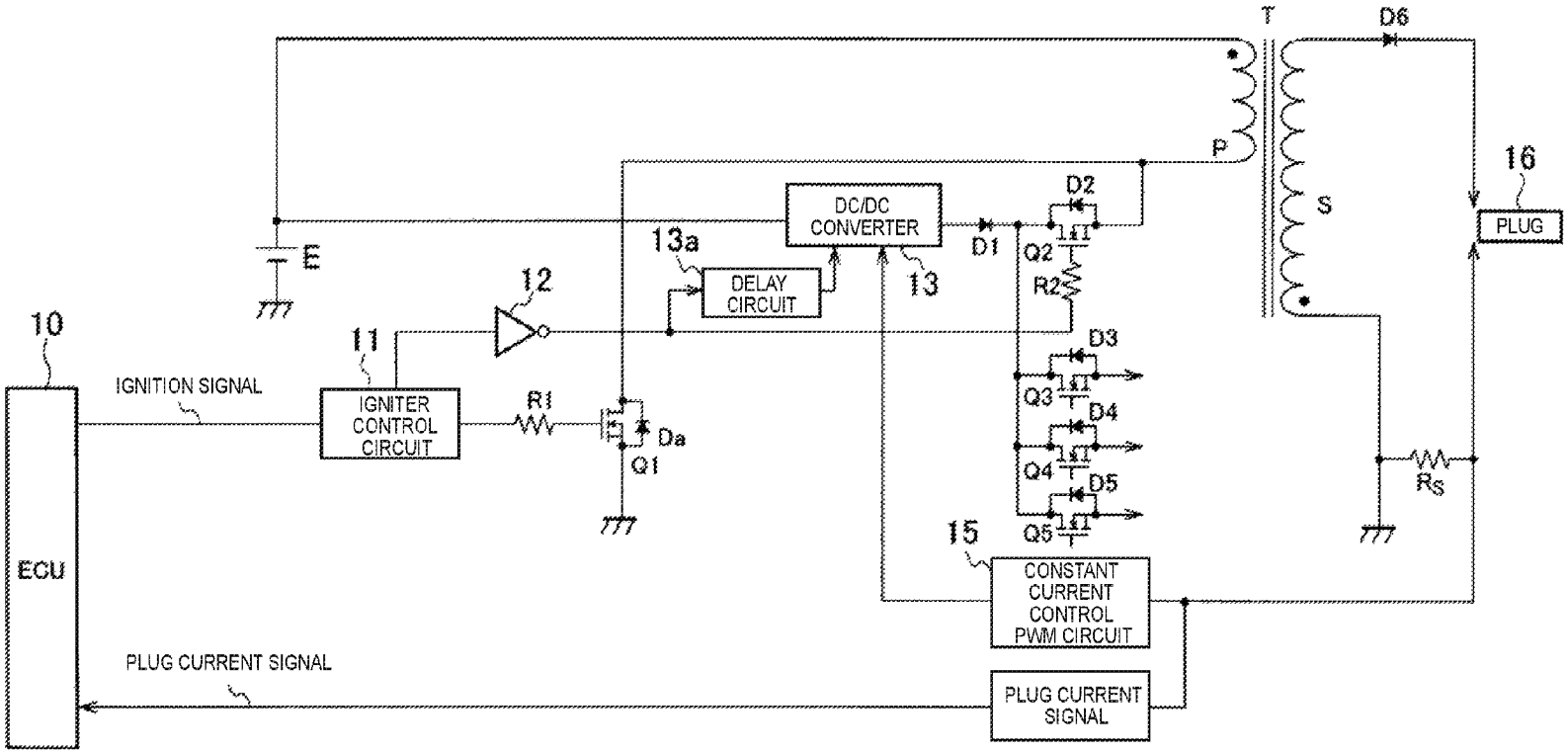
FIG. 1 is a diagram illustrating a circuit configuration of an ignition device according to Example 1.

Embodiments are described below in detail with reference to the drawings. FIG. 1 is a diagram illustrating a circuit configuration of an ignition device according to Example 1. Note that constituents in FIG. 1 which are the same as those in the conventional ignition device illustrated in FIG. 6 are denoted by the same reference numerals used in the description of the background.

The ignition device of Example 1 includes igniter control circuit 11, igniter switch Q1, transformer T, battery E, diodes D1 to D6, and Da, inverter 12, DC/DC converter 13, delay circuit 13*a*, constant current control PWM circuit 15, MOSFETs Q2 to Q5, resistors R1 and R2, and shunt resistor Rs.

Engine control unit (ECU) 10 outputs an ignition signal to igniter control circuit 11. Igniter control circuit 11 receives the ignition signal from ECU 10, and turns igniter switch Q1 on and off via resistor R1 by using the ignition signal. Igniter switch Q1 is included in a first switch and is formed from an N-type MOSFET.

Transformer T is included in an ignition coil, and is provided with igniter winding P (included in a first winding), and secondary winding S (included in a second winding) in a reverse phase to igniter winding P, which are electromagnetically coupled to each other.

One end of igniter winding P is connected to a drain of igniter switch Q1. Meanwhile, a positive electrode of battery E is connected to another end of igniter winding P while a negative electrode of battery E is grounded. Diode Da is connected between the drain and a source of igniter switch Q1. Diode Da may be a parasitic diode in igniter switch Q1.

Inverter 12 inverts the ignition signal from igniter control circuit 11 and outputs the inverted ignition signal to a gate of MOSFET Q2 via resistor R2. Delay circuit 13*a* delays the inverted ignition signal from inverter 12 by a predetermined time period and then outputs the signal to DC/DC converter 13.

DC/DC converter 13 is included in a booster, and is formed from a publicly known switching regulator. DC/DC converter 13 boosts a voltage of battery E by using the inverted ignition signal from inverter 12, and supplies the boosted voltage via diode D1 to drains of four MOSFETs Q2 to Q5 that are connected in parallel.

Four MOSFETs Q2 to Q5 are provided corresponding to four cylinders of an internal combustion engine. In FIG. 1, diodes D2 to D5 are connected between drains and sources of MOSFETs Q2 to Q5, respectively. Diodes D2 to D5 may be parasitic diodes in MOSFETs Q2 to Q5. The source of MOSFET Q2 is connected to one end of igniter winding P.

Each of MOSFETs Q2 to Q5 (included in a second switch) is formed from an N-type MOSFET, which is turned on and off by the inverted ignition signal from inverter 12 inputted to agate thereof.

Meanwhile, DC/DC converter 13 performs a boosting operation, i.e., a switching operation in response to an internal signal to be described later during a period when MOSFET Q2 is in an on-state, to continue supply of electric energy to igniter winding P. In this regard, DC/DC converter 13 starts supply of the electric energy after a lapse of a predetermined time period from a point when MOSFET Q2 is changed from an off-state to the on-state.

Igniter control circuit 11 and inverter 12 are included in a drive device. The drive device feeds a secondary current to secondary winding S by changing igniter switch Q1 from an on-state to an off-state, and supplies an output from DC/DC converter 13 to igniter winding P by changing MOSFET Q2 from the off-state to the on-state, thereby extending a time period for supplying the secondary current.

An anode of diode D6 is connected to one end of secondary winding S of transformer T, and one end of plug 16 is connected to a cathode of diode D6. Another end of plug 16 is connected to one end of shunt resistor Rs and to an input terminal of constant current control PWM circuit 15. Another end of shunt resistor Rs is connected to another end of secondary winding S and to the ground. A plug current signal from shunt resistor Rs is outputted to ECU 10.

Constant current control PWM circuit 15 outputs to DC/DC converter 13 the internal signal for controlling the secondary current at a constant value by detecting the secondary current flowing on secondary winding S of the ignition coil while using shunt resistor Rs, and comparing a detected value with an internal reference value.

Here, constant current control PWM circuit 15 illustrated in FIG. 1 is provided outside DC/DC converter 13. Instead, constant current control PWM circuit 15 may be provided inside DC/DC converter 13, for example.

Next, an operation of the ignition device of the example thus configured is described in detail with reference to an operation waveform diagram illustrated in FIG. 2 regarding the constituents of the ignition device.

Figure 2:
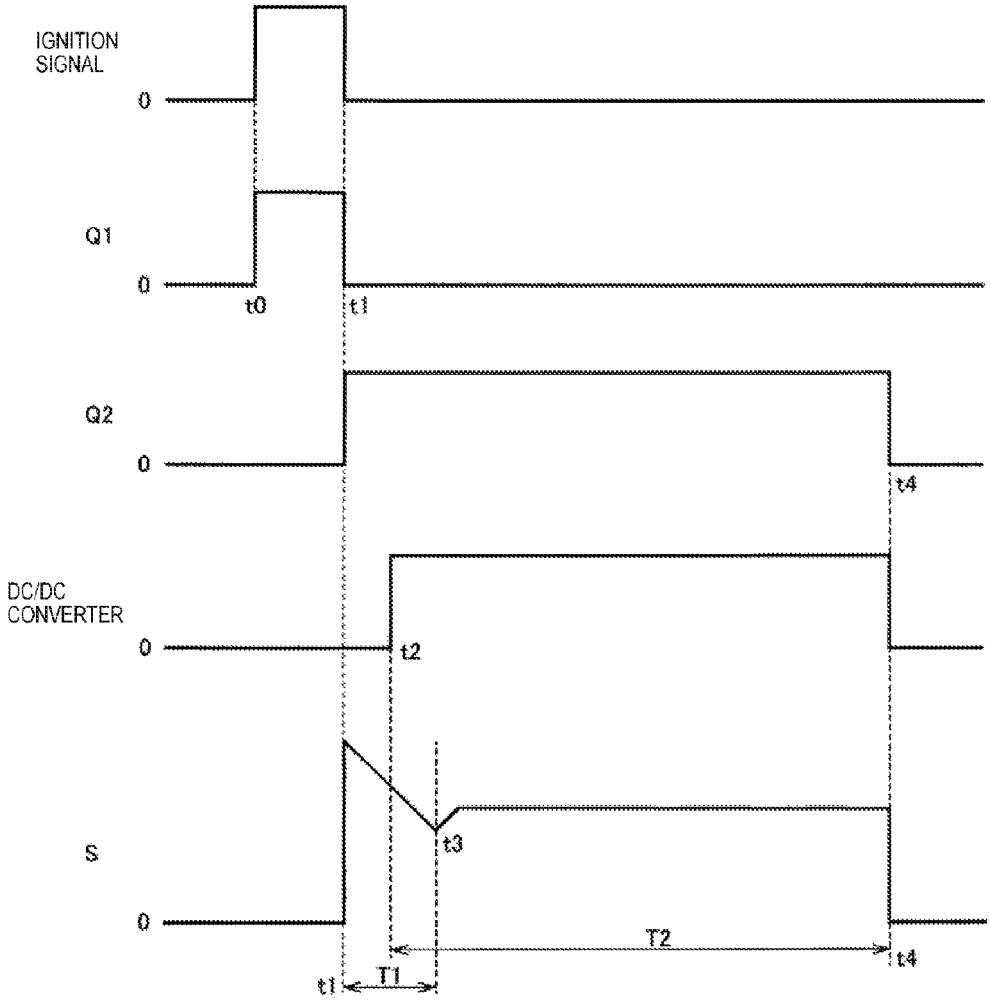
FIG. 2 is an operation waveform diagram regarding constituents of the ignition device according to Example 1.
Figure 3:
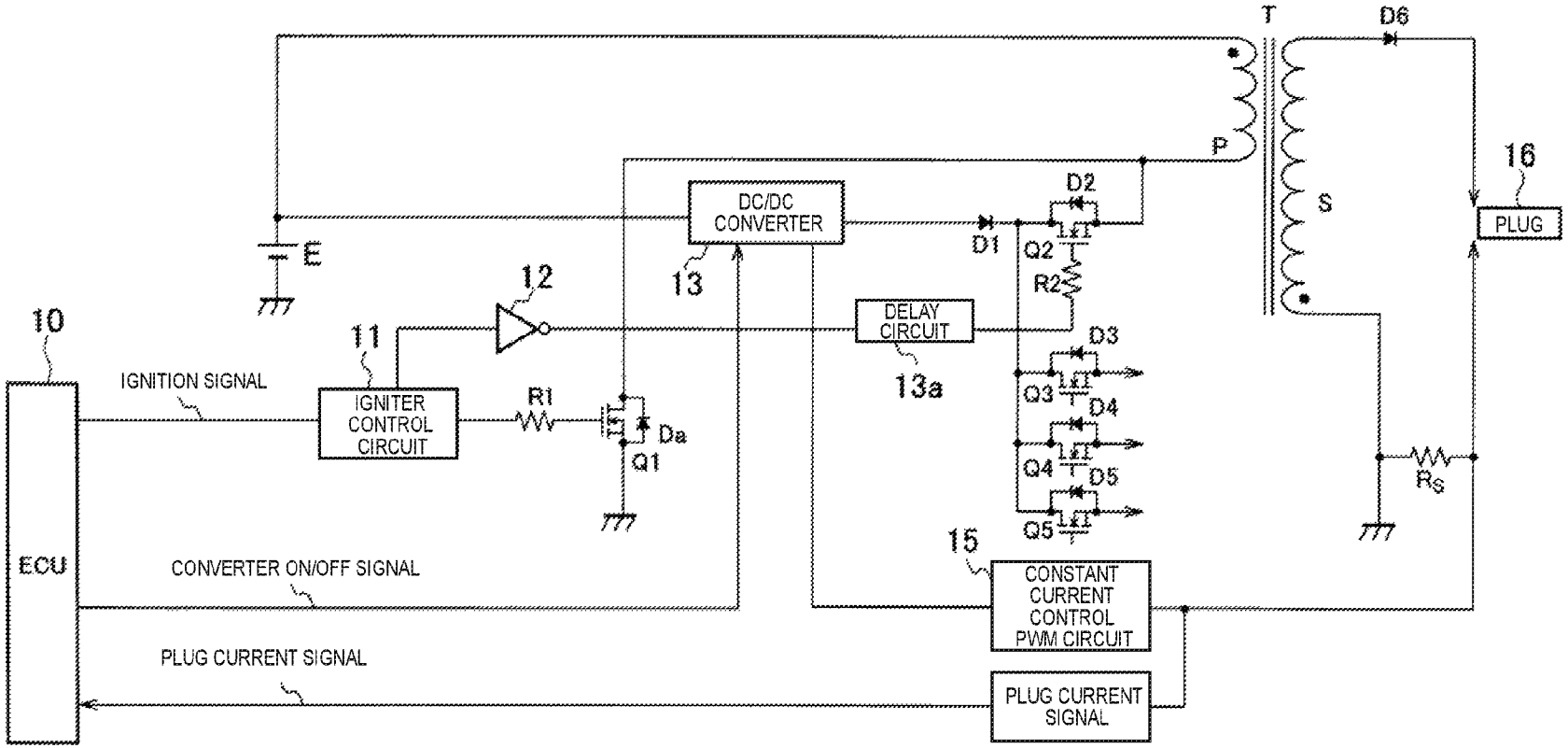
FIG. 3 is a diagram illustrating a circuit configuration of an ignition device according to a modified example of Example 1.

Note that in FIG. 2, a line indicated with IGNITION SIGNAL represents a signal sent from ECU 10, a line Q1 represents an operation from igniter switch Q1, a line Q2 represents an operation from MOSFET Q2, a line DC/DC CONVERTER represents an output from DC/DC converter 13, and a line S represents energy of secondary winding S of transformer T.

First, during a period from time t0 to time t1, igniter control circuit 11 applies an H-level ignition signal to a gate of igniter switch Q1. Hence, igniter switch Q1 is on during the period from time t0 to time t1.

Then, a current is fed from battery E to the ground via igniter winding P and igniter switch Q1, and the energy is stored in igniter winding P. At this time, electric potential on a winding finish side of igniter winding P is lower than electric potential on a winding start side thereof. Accordingly, electric potential on a winding finish side of secondary winding S is lower than electric potential on a winding start side thereof as well. For this reason, diode D6 on the secondary winding side is turned off and no secondary current flows thereon.

Next, at time t1, igniter control circuit 11 applies an L-level ignition signal to the gate of igniter switch Q1. Hence, igniter switch Q1 is turned off. Here, the electric potential on the winding start side is lower than the electric potential on the winding finish side in each of igniter winding P and secondary winding S. Accordingly, the secondary current flows from the winding start side of secondary winding S via diode D6 and shunt resistor Rs and the energy is supplied to plug 16. The energy of secondary winding S is supplied to plug 16 and therefore gradually reduced over period T1 from time t1 to time t3.

Meanwhile, at time t1, the L-level ignition signal from igniter control circuit 11 is inverted to the H level by inverter 12. Thus, the H-level ignition signal is supplied to the gate of MOSFET Q2. As a consequence, MOSFET Q2 is turned on during a period from time t1 to time t4.

Next, delay circuit 13*a* delays the H-level ignition signal inverted by inverter 12 for a predetermined time period starting from time t1. DC/DC converter 13 is activated at time t2 (at time in the middle of time t1 and time t3) after the delay for the predetermined time period. DC/DC converter 13 boosts the voltage of battery E and supplies the boosted voltage via diode D1 to the drains of four MOSFETs Q2 to Q5 that are connected in parallel.

As a consequence, concerning MOSFET Q2, the current is fed from DC/DC converter 13 to battery E via diode D1, MOSFET Q2, and igniter winding P. As with the case of MOSFET Q2, concerning each of MOSFETs Q3 to Q5, the current is fed from DC/DC converter 13 to battery E via diode D1, MOSFET Q3, Q4, or Q5, and a constituent component corresponding to igniter winding P for each cylinder.

At this time, electric potential on a winding start side is lower than electric potential on a winding finish side in each of igniter winding P and secondary winding S. Accordingly, the secondary current flows from the winding finish side of secondary winding S via diode D6, plug 16, and shunt resistor Rs and the energy is supplied to plug 16. Thus, the energy of igniter winding P is superposed on secondary winding S over a period T2 from time t2 to time t4.

In other words, by feeding the current from auxiliary DC/DC converter 13 to igniter winding P, the energy from igniter winding P is supplied from secondary winding S to plug 16 at the timing (the period from time t1 to time t3) when fly-back energy of secondary winding S is reduced. Thus, a time period to supply the secondary current is extended and ignition time of plug 16 is extended accordingly.

As described above, according to the ignition device of Example 1, igniter control circuit 11 and inverter 12 which serve as the drive device feed the secondary current to secondary winding S by changing igniter switch Q1 from the on-state to the off-state, and supply the output from DC/DC converter 13 to igniter winding P by changing MOSFET Q2 from the off-state to the on-state, thereby extending the time period to supply the secondary current. It is therefore possible to extend the ignition time of plug 16 and thus to improve combustion efficiency of fuel.

During the period when MOSFET Q2 is in the on-state, DC/DC converter 13 continues the boosting operation so as to control the secondary current at the constant value, and continues supply of the electric energy to igniter winding P. Accordingly, it is possible to reduce capacitance of an output capacitor of DC/DC converter 13. In addition, a fluctuation of electrical stress associated with turning the capacitor on and off is reduced, whereby stress affecting a life of an electrolytic capacitor can be reduced. As a consequence, reliability of the ignition device is improved.

Meanwhile, MOSFET Q2 is turned on earlier by a predetermined time period than the activation of DC/DC converter 13 and in the state where a relatively low voltage is applied thereto. Accordingly, electrical stress is reduced when turning MOSFET Q2 on.

In the meantime, DC/DC converter 13 repeats start and stop in response to the ignition signal. This configuration suppresses heat generation from the constituent components of DC/DC converter 13 and thus improves the reliability of the ignition device.

Figure 4:
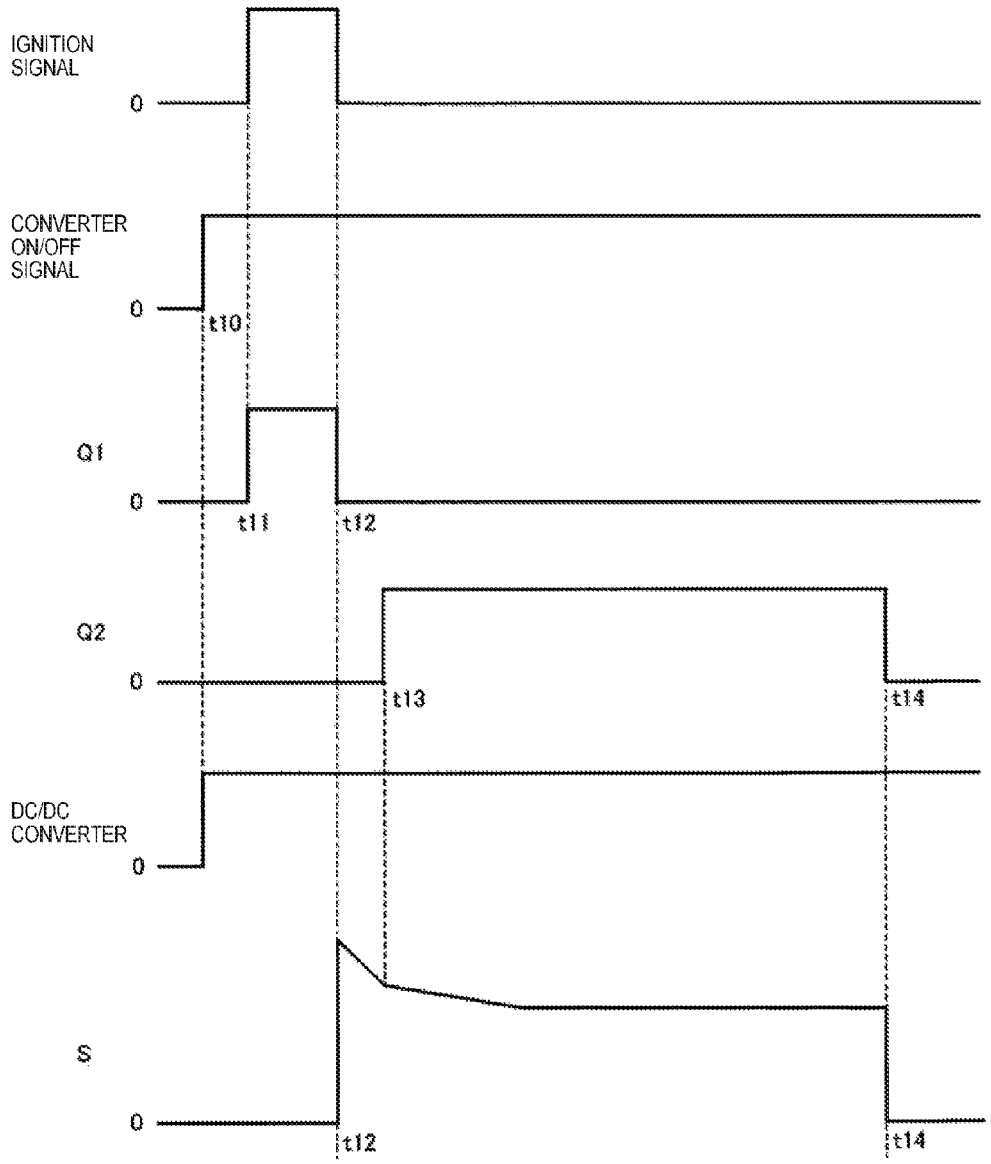
FIG. 4 is an operation waveform diagram regarding constituents of the ignition device according to the modified example.

Alternatively, delay circuit 13*a* illustrated in FIG. 1 may be removed and delay circuit 13*a* may be connected between an output end of inverter 12 and the gate of MOSFET Q2 instead. In this case, as illustrated in FIG. 4, DC/DC converter 13 is activated at time t10 by a converter on/off signal (an activation signal) different from the ignition signal, and continues the boosting operation regardless of the state of MOSFET Q2. At time t11, igniter switch Q1 is turned on by the ignition signal. At time t12, igniter switch Q1 is changed from the on-state to the off-state, whereby the secondary current is fed to secondary winding S. Meanwhile, at time t13 which is delayed by a predetermined time period by delay circuit 13*a*, MOSFET Q2 is changed from the off-state to the on-state. Thus, the output from DC/DC converter 13 is supplied to igniter winding P.

The output from DC/DC converter 13 is supplied to igniter winding P at the timing when the fly-back energy of secondary winding S is reduced. In this case, the stress affecting the life of the electrolytic capacitor is reduced, and the reliability of the ignition device is thus improved.

Figure 5:
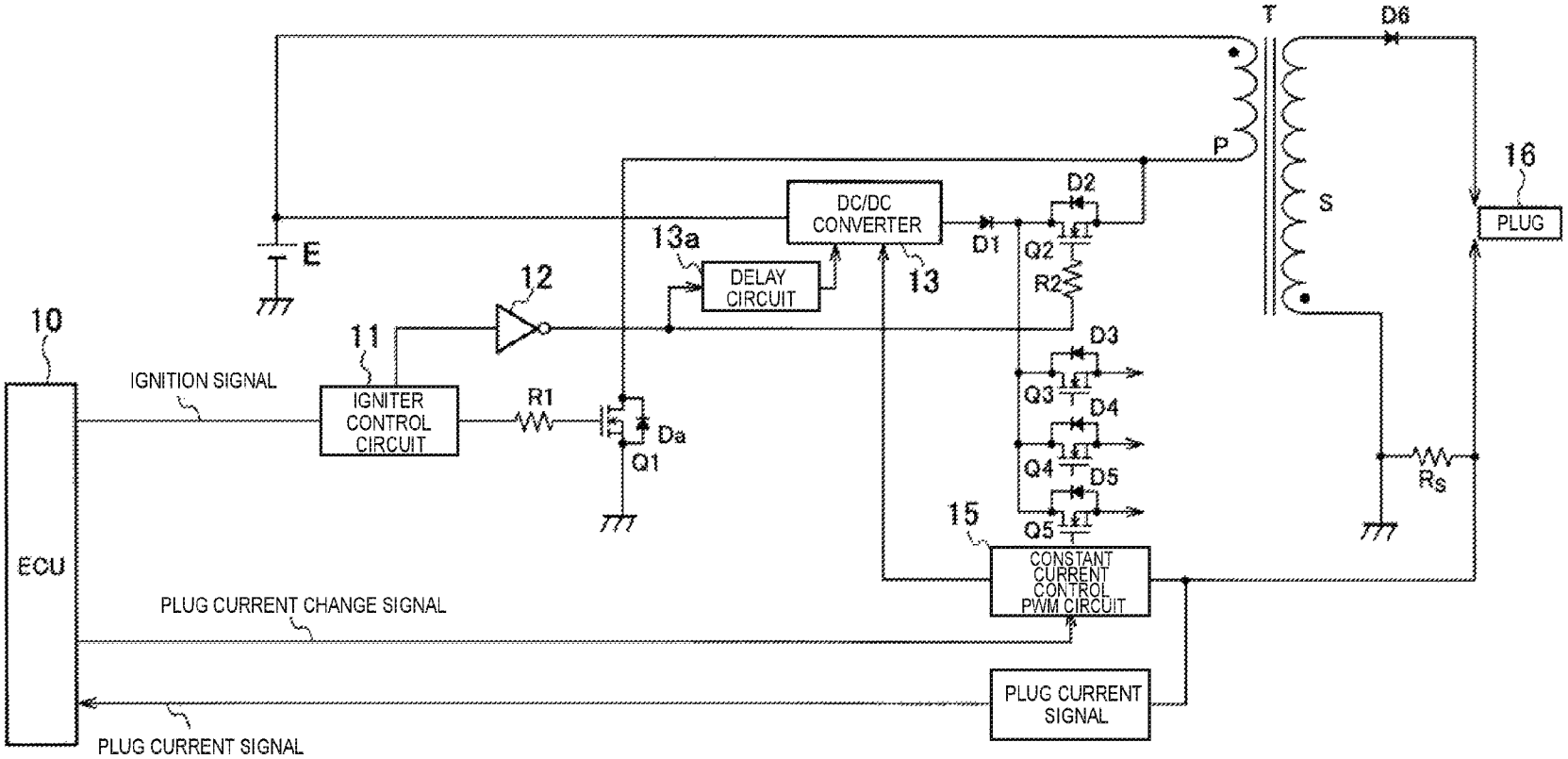
FIG. 5 is a diagram illustrating a circuit configuration of an ignition device according to another modified example.

Meanwhile, as illustrated in FIG. 5, engine control unit (ECU) 10 may be configured to output the ignition signal to igniter control circuit 11 and to output a plug current change signal to constant current PWM circuit 15. In this case, constant current control PWM circuit 15 outputs the internal signal for increasing or decreasing the secondary current to DC/DC converter 13 while adjusting the internal reference value in accordance with the plug current change signal. The increase in secondary current can prevent an accidental fire.

Transformer Ta of the technique disclosed in above-described Patent Document 1 is configured to generate a high voltage on a secondary side and therefore has a high winding number ratio as the transformer. Accordingly, the energy stored in transformer Ta is significantly consumed by voltage conversion. For this reason, transformer Ta can supply the current to plug 16 only for a short time, and the ignition time of plug 16 is therefore limited. As a consequence, combustion efficiency of fuel is reduced and there is a concern of deterioration of exhaust gas due to incomplete combustion of part of the fuel.

According to the embodiment, the drive device feeds the secondary current to the secondary winding by changing the first switch from the on-state to the off-state, and supplies the output from the booster to the first winding by changing the second switch from the off-state to the on-state. Thus, it is possible to extend the ignition time of the plug, and thus to improve the combustion efficiency of the fuel.

As described above, according to the embodiment, it is able to provide the ignition device which is capable of improving the combustion efficiency of the fuel by extending the ignition time of the plug.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. An ignition device comprising:

an ignition coil including a first winding and a second winding electromagnetically coupled to each other;

a first switch electrically connected to a first end of the first winding;

a battery electrically connected to a second end of the first winding;

a booster with a first end electrically connected to the battery;

a second switch electrically connected to a second end of the booster and to the first end of the first winding; and a drive device electrically connected to the first switch, that turns the first switch and the second switch on and off, wherein the drive device feeds a secondary current to the second winding by changing the first switch from an on-state to an off-state, and supplies an output from the booster to the first winding by changing the second switch from an off-state to an on-state, and the booster comprises a constant current control circuit that detects the secondary current flowing into the second winding of the ignition coil, and controls the detected secondary current at a constant value.

2. The ignition device of claim 1, wherein the booster continues a boosting operation and continues supply of electric energy to the first winding during a period when the second switch is in the on-state.

3. The ignition device of claim 1, wherein the booster comprises a delay circuit that supplies an output of electric energy after a lapse of a predetermined time period from a point when the second switch is changed from the off-state to the on-state.

4. The ignition device of claim 1, wherein the booster starts a supply of an output of electric energy by a predetermined time period earlier than a time when the second switch is changed from the off-state to the on-state.

5. The ignition device of claim 1, wherein the drive device comprises:

an igniter control circuit that receives an ignition signal from an engine control unit and outputs a signal for controlling the on-state and the off-state of the first switch in response to receiving the ignition signal; and an inverter that inverts the received ignition signal and that outputs the inverted ignition signal for controlling the on-state and the off-state of the second switch.

* * * * *